US005345979A

United States Patent [19]

Tucker et al.

[11] Patent Number: 5,345,979

[45] Date of Patent: Sep. 13, 1994

[54] HIGH EFFICIENCY VAPOR RECOVERY FUEL DISPENSING

[75] Inventors: Mark B. Tucker, Colfax; Edward A. Payne, Greensboro; Paul D. Miller, Winston-Salem, all of N.C.

[73] Assignee: Gilbacro, Inc., Greensboro, N.C.

[21] Appl. No.: 968,595

[22] Filed: Oct. 29, 1992

[51] Int. Cl.[5] ..... B65B 1/04

[52] U.S. Cl. ..... 141/1; 141/5; 141/44; 141/46; 141/59; 141/83; 141/128

[58] Field of Search ..... 141/59, 44–46, 141/83, 128, 1, 4, 5, 51

[56] References Cited

U.S. PATENT DOCUMENTS

| | | | |
|---|---|---|---|
| 3,874,427 | 4/1975 | Tiggleback | 141/52 |
| 4,202,385 | 5/1980 | Voelz et al. | 141/59 |
| 4,223,706 | 9/1980 | McGahey | 141/59 |
| 4,260,000 | 4/1981 | McGahey et al. | 141/59 |
| 4,649,970 | 3/1987 | Bower et al. | 141/302 |
| 4,798,306 | 1/1989 | Giacomazzi | 141/44 X |
| 5,038,838 | 8/1991 | Bergamini et al. | 141/59 |
| 5,040,577 | 8/1991 | Pope | 141/59 |
| 5,156,199 | 10/1992 | Hartsell, Jr. et al. | 141/83 |
| 5,172,738 | 12/1992 | Komukai et al. | 141/83 |
| 5,195,564 | 3/1993 | Spalding | 141/1 |
| 5,197,523 | 3/1993 | Fink, Jr. et al. | 141/206 |
| 5,269,353 | 12/1993 | Nanaji et al. | 141/59 |
| 5,280,814 | 1/1994 | Stroh | 141/83 |

FOREIGN PATENT DOCUMENTS

| | | |
|---|---|---|
| 2817980 | 11/1978 | Fed. Rep. of Germany . |
| 8717378.6 | 10/1988 | Fed. Rep. of Germany . |

*Primary Examiner*—Ernest G. Cusick

*Attorney, Agent, or Firm*—Rhodes Coats & Bennett

[57] ABSTRACT

An apparatus for dispensing volatile liquid fuel with recovery of fuel vapors includes a fuel delivery system having a fuel delivery line and a pump in the line to pump fuel there-along to a nozzle. A vapor recovery subsystem includes a vapor return line from the nozzle and a vapor impulsion means to induce vapor to flow through the vapor return line at a vapor flow rate comparable to the liquid flow rate through the fuel delivery line during most of a fueling operation. A vapor impulsion booster boosts the vapor flow rate above the liquid flow rate early in a fueling operation.

26 Claims, 4 Drawing Sheets

HIGH EFFICIENCY VAPOR RECOVERY FUEL DISPENSING

BACKGROUND OF THE INVENTION

The present invention relates to improvements in vapor recovery fuel dispensers, in particular improvements in retrieving vapors which have hitherto been oftentimes lost.

Vapor recovery dispensers have been known for a good many years, and have been required in California and other areas with high proportions of hydrocarbons in the atmosphere for a number of years. The vapors to be recovered are located initially in the automobile tank and are displaced by the incoming liquid fuel as the tank is being refueled. The most widely used systems have operated on the "balance" principle in which an outer sheath is provided at the nozzle to fit around a filler pipe of an automobile gasoline tank. The sheath, if all goes right, makes a tight fit around the filler cap so that the vapor can pass only through the sheath (or, as it is commonly called, the "boot"), to a vapor return line connected with the service station's fuel tank. Thus, as the fuel is taken from the station's fuel tank and pumped into the automobile, the liquid volume being reduced is supplanted with returning vapors.

However, the balance systems, with their boots, are very cumbersome, at best, and oftentimes do not make a good fit with the automobile tank filler pipe, so that vapors are lost to the atmosphere.

Recently, Gilbarco, Inc. of Greensboro, N.C. has promoted a vapor recovery system that it markets as VAPOR VAC#. This is a bootless system, with the vapors being returned under positive drive by a vapor pump located in the vapor return line, as disclosed in U.S. Pat. No. 5,040,577 to Pope and assigned to Gilbarco, Inc. Various improvements on the Pope apparatus disclosure are made in U.S. patent Appln. Ser. No. 07/946,741 of Edward A. Payne entitled "Vapor Recovery Improvements" filed Sep. 16, 1992. Both of these disclosures are hereby incorporated herein by reference.

One of the advantages accruing from the use of a separately-provided vapor pump in the vapor return line is the ability to precisely control the vapor flow through the vapor return line, so that the vapor flow rate can be tailored to prescribed conditions. This is outlined more in the Payne application referred to above.

However, in the implementation of virtually all vapor recovery systems, except those which have perfectly formed boot seals, some vapor is invariably lost to the atmosphere, forming pollution. Applicants have found that one of the major vapor losses occurs at the start of the fueling process, as the liquid fuel is first released from the nozzle into the fuel filler pipe. This "puff" of vapor is released quickly, as a transient event. The vapor recovery pump is effective in drawing virtually all of the vapor liberated, once the transient event has passed. It is not desirable to raise the vapor pumping rate on a continuous basis, since air will be drawn in, which might lead to a dangerously lean vapor condition or over pressure in the storage tanks. Accordingly, means is still needed to deal with the transient event of the "puff" loss, which occurs at the start of liquid fueling.

SUMMARY OF THE INVENTION

The present invention fulfills this need in the art by providing an apparatus for dispensing volatile liquid fuel with recovery of fuel vapors including a fuel delivery system having a fuel delivery line and a pump in the line to pump fuel there-along to a nozzle, a vapor recovery subsystem having a vapor return line from the nozzle and a vapor impulsion means to induce vapor to flow through the vapor return line at an ordinary vapor flow rate comparable to the liquid flow rate through the fuel delivery line during most of a fueling operation, and a vapor impulsion booster to boost the vapor flow rate above the ordinary vapor flow rate early in a fueling operation.

According to one aspect of the invention, the vapor impulsion means is a vapor pump, and the vapor impulsion booster includes a valve in the vapor return line upstream of the vapor pump and a timer circuit. The timer is operable to start the vapor pump before opening the valve and pumping with the liquid pump, so that a vacuum may be drawn in the vapor return line before liquid is pumped. Preferably, the vapor pump is an electrically driven pump and the vapor impulsion means includes circuitry to operate the vapor pump at a speed to pump vapor at a rate comparable to the liquid flow rate.

In another aspect the vapor impulsion means is a vapor pump and the vapor impulsion booster includes circuitry to operate the vapor pump at a speed to pump vapor at a rate greatly in excess of the liquid flow rate early in the fueling operation. Preferably, the excess may be characterized by a fast rise time to a maximum and a gradual decrease. In one embodiment the gradual decrease is a time-decaying exponential. But, the waveform can be of any desired shape, including those selected from the group consisting of exponential, transcendental, ramp, step, pulse or a combination thereof. Also the gradual decrease may be modulated by sensing liquid passed in the fueling operation or vapor recovered.

Preferably, the nozzle is bootless.

The invention also provides a method of dispensing volatile liquid fuel with recovery of fuel vapors including pumping fuel through a fuel delivery line at a liquid flow rate to a nozzle, returning vapors along a vapor return line from the nozzle at an ordinary vapor flow rate comparable to the liquid flow rate through the fuel delivery line during most of a fueling operation, and boosting the vapor flow rate above the ordinary vapor flow rate early in a fueling operation.

According to one aspect, the boosting step includes pumping the vapor along the vapor return line while a valve in the vapor return line upstream of the vapor pump is closed and subsequently opening the valve and pumping the liquid, so that a vacuum is drawn in the vapor return line before liquid is pumped to provide a boost above the ordinary vapor flow rate at the start of the fueling operation. In this aspect it is preferred for the vapor returning step to include electrically driving a vapor pump at a speed to pump vapor at a rate comparable to the liquid flow rate as the ordinary vapor flow rate.

According to another aspect of the method, the vapor returning step includes pumping the vapor with an electrically-driven vapor pump and the boosting step includes supplying electrical signals to the vapor pump to operate the vapor pump at a speed to pump vapor at a rate greatly in excess of the liquid flow rate early in the fueling operation. In one embodiment, the excess may be characterized by a fast rise time to a maximum and a gradual, time-decaying exponential decrease. But, the wave-form can be of any desired shape, including those selected from the group consisting of exponential, transcendental, ramp, step, pulse or a combination thereof. And the gradual decrease may be modulated by the volume of liquid pumped or vapor recovered.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
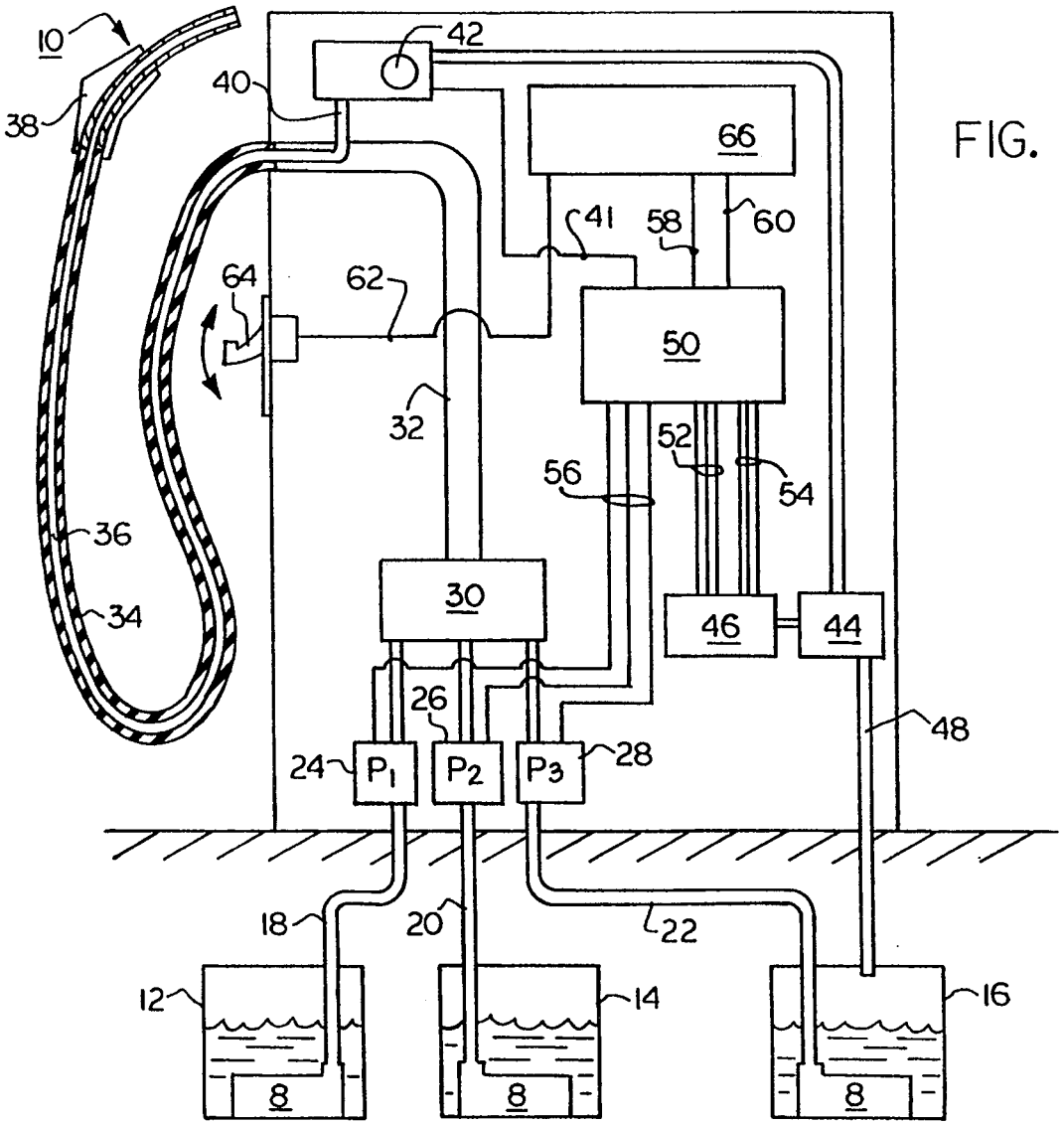
FIG. 1 is a schematic block diagram of a fuel dispenser according to one embodiment of the invention.

A preferred embodiment of the invention is shown in schematic form in FIG. 1. The fuel dispenser 10, preferably a gasoline dispenser, is connected to a multiplicity of turbine pumps 8 in gasoline storage tanks 12,14,16 through pipes 18,20,22, respectively. The pipes receive gasoline from the tanks and the respective liquid flow rates are measured in meters 24,26,28. The fuel from the pipes is mixed in mixing manifold 30. The mixing manifold has downstream of it a pipe 32 which outlets to a hose 34, terminating in a controllable dispensing nozzle 38. The nozzle 38 is provided with a vapor return line which connects with a vapor return hose 36 in the hose 34, preferably concentrically within it. The vapor return hose 36 connects with a vapor line 40 extending to a vapor pump 44. An electrically operated solenoid valve 42 is provided in line 40 to close off the vapor line when not in use.

Various other tank, liquid pump, vapor pump, and meter arrangements can also be used. In particular, the invention is useful for dispensers in which the output of each meter is passed to a separate hose, without any mixing. In such a case, the signals output on lines 56 will be exclusive; i.e. there will be a signal indicative of liquid flow only on one of the lines at a time. Dispensers of this type are sold by Gilbarco, Inc. under the MPD designation.

A conventional handle 64 is mounted in the outside wall of the dispenser 10, on which the nozzle 38 can rest when not in use. As is conventional, the handle 64 is pivotally mounted, so it can be lifted after the nozzle is removed, to activate a switch, and the activation of the switch is signalled along line 62 to a transaction computer 66.

Controller 50 is provided with electrical connections 56 with the meters 24,26,28, so that signals indicative of the liquid flow rate can be transmitted from the meters to the controller 50. Preferably the meters 24,26,28 are pulsers, such as are commonly used in gasoline dispensers made by Gilbarco, Inc. The pulsers emit a pulse for every 1/1000th of a gallon of gasoline passed by the meter. Thus, as the fuel is being pumped, a pulse train is delivered on the respective lines of the connections 56, with the pulse train frequencies corresponding to the liquid flow rate. The liquid pumps may, of course, be located in the dispenser 10, or elsewhere, and may have the metering devices integral with them.

Controller 50 also has a connection 41 to the valve 42 to open or close that valve, as desired. Controller 50 also has connections 58,60 to the transaction computer 66 which controls the overall operation of the dispenser 10, in conventional fashion. Line 58 transmits signals from the transaction computer 66 to the controller 50 indicating that pumping is desired, and line 60 transmits signals from the controller 50 to disable pumping, when the controller 50 has ascertained that pumping should be disabled. These are discussed in more detail in Gilbarco's co-pending application Ser. No. 07/946,741 filed Sep. 16, 1992.

The vapor pump 44 is preferably a positive displacement pump, such as the Blackmer Model VRG3/4. It is driven by a motor 46, preferably a brushless three-phase DC motor. The brushless DC motor 46 includes three hall effect sensors, one for each phase of the three-phase motor. These are used in conventional motor drive electronics in the controller 50 to apply appropriately phased power to the three phase motor 46. The hall effect signals are a form of feedback and indicate the angular displacement of the motor. Rates of change of angular displacement signalled by the hall effect sensors by a pulse frequency are sent over lines 52 to the controller 50. That is, the lines 52 provide a tachometer reading of the rate of rotation of the motor 46. The motor drive electronics portion of the controller 50 outputs three-phase power over lines 54 to the motor to drive the motor as desired. Of course, if desired, the motor can be separately driven with a separately denominated motor drive which takes its instructions from the controller 50.

The vapor of the vapor pump 44 is transmitted along line 48 back to a storage vessel such as tank 16. The returning vacuum can be transmitted via a manifold system to the plurality of tanks 12,14,16 or, as shown more simply in FIG. 1, to one tank.

The controller 50 plays a number of important roles which are fully described in Gilbarco's patent application Ser. No. 07/946,741 filed Sep. 16, 1992. However, to generalize, the flow rate of the liquid being pumped through the lines 18, 20, 22 as controlled by the transaction computer 66, via a connection not shown, is transmitted to the controller 50 over lines 56. The controller 50 evaluates the pulse trains 56 and output signals over lines 54 to the motor 46 to drive the vapor pump 44 at a rate comparable with the liquid pumping rate. Thus, generally the faster the liquid is pumped out, the faster the vapor is retrieved.

Figure 2:
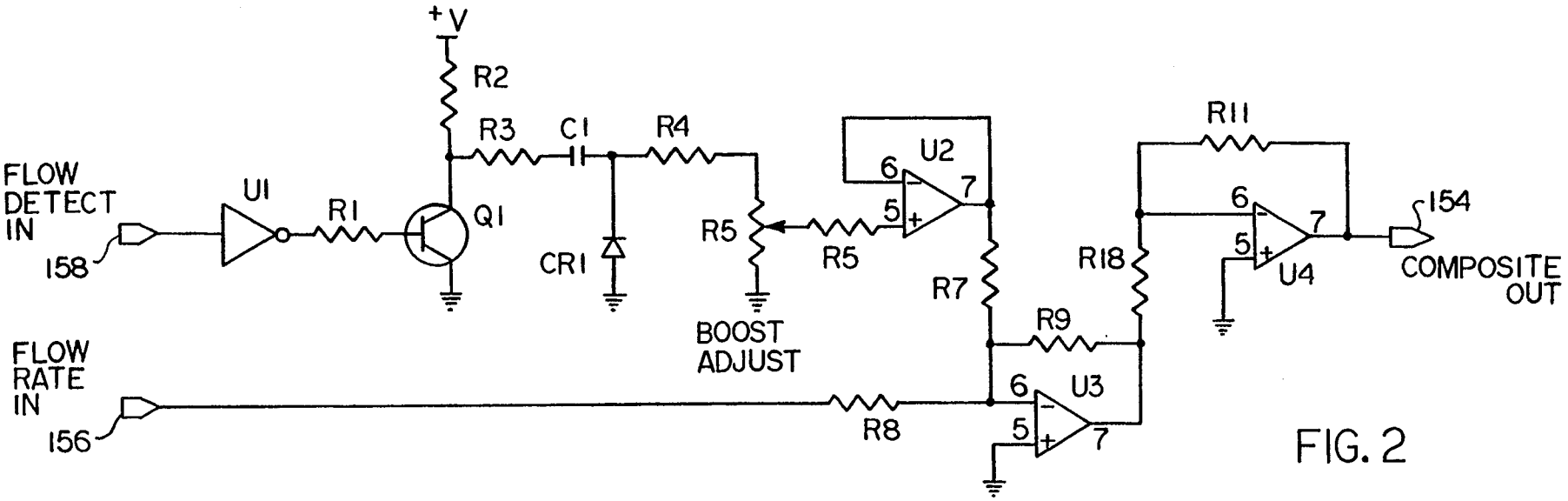
FIG. 2 is a schematic diagram of a circuit used in the fuel dispenser embodiment of FIG. 1.

The foregoing description is taken largely from application Ser. No. 07/946 741 and describes in general the operation of a vapor recovery fuel dispenser in which a vapor pump is provided having its speed correlated with the speed of the liquid flow. However, in order to accommodate the retrieval of the "puff" generated at the start of the fueling operation, an additional circuit shown in more detail in FIG. 2 is desirable. The liquid flow rate data provided over electrical connections 56 are converted to an analog voltage as described in copending application Ser. No. 07/946,741 filed 16 September 1992 and condensed into a single, analog FLOW_RATE_IN signal 156 indicative of the overall flow. The start of a train of pulses on lines 56 can also be used to derive a FLOW_DETECT_IN signal 158. The circuit shown in FIG. 2 will act upon these two signals 156,158 to generate modifications to the flow rate 156 at the inception of flow. The circuit will provide a COMPOSITE_OUT signal 154. Signal 154 is directly proportional to the speed of the vapor pump motor, from which the three-phase output signals 54 to the motor 46 are derived. At the inception of liquid flow as detected by signal 158, the COMPOSITE_OUT signal 154 will be used to drive the motor 46 at a high rate. Once the transient "puff" has passed, the COMPOSITE_OUT signal will be nearly congruent with the FLOW_RATE_IN signal 156.

The burst compensation system of FIG. 2 employs analog electronic techniques. However, those of ordinary skill in the art could likewise employ a variety of digital, software, or mechanical embodiments to achieve similar compensation effects.

A time-decaying exponential is used as the boost term in this example. Any function which decreases or terminates with time, the volume of fuel dispensed, or the volume of vapors recovered, including but not limited to transcendentals, ramps, steps, or pulses, or a combination thereof, could similarly be employed to remove an effective quantity of the vapor "puff".

Also, in this example, the boost term is employed as an additive quantity to the flow rate term, although the effective vapor burst compensation may be similarly achieved by applying the boost term as a multiplicative term to the flow rate. Similarly, both additive or multiplicative techniques may be applied downstream to the final V/L (vapor to liquid proportion, which may well be other than 1:1, as disclosed in Gilbarco's U.S. Pat. No. 5,156,199) term which is typically derived by multiplying the flow term by a scaling factor for the chosen V/L ratio, and which may also contain an offset term at this point.

Finally, both additive and multiplicative operations may be applied simultaneously to the flow or V/L terms, using identical or differing boost function terms.

FIG. 2 depicts one such embodiment where at the detection of flow, inputted as the boolean term FLOW_DETECT_IN, the output of inverter U1 is driven low, causing transistor, Q1 which is driven through current limiting resistor R1, to turn off. At the instance in time where transistor Q1 turns off, referenced as t=0, capacitor Cl has very little accumulated charge, and therefore represents a small voltage drop. Consequently, the voltage potential appearing across potentiometer R5 $V_{R5}$ is approximately represented by:

$$V_{R5}=+V*R5/(R2+R3+R4+R5)$$

At time greater than t=0, capacitor C1 begins to accumulate a charge, which increases the voltage drop across capacitor C1. The time constant T, at which capacitor C1 accumulates charge, is given by:

$$T=C1*(R2+R3+R4+R5)$$

And the voltage across capacitor C1, $V_{c1}$, at any point in time, t, will be represented by the decaying exponential function:

$$V_{c1}(t)=+V*(1-e^{-t/T})$$

The time-variant voltage across potentiometer R5, $V_{R5}$ may be represented by the function:

$$V_{R5(t)}=(+V-V_{c1}(t))*R5/(R2+R3+R4+R5)$$

The desired level of boost is chosen by potentiometer R5, configured as a voltage divider. This voltage is then fed through isolation resistor R6, then into an operational amplifier U2 configured as a voltage follower. Voltage follower U2 acts as an impedance converter, such that a high impedance is presented to the wiper of R5. For any given setting of R5, no appreciable loading or impedance change occurs in the network preceding and including R5. Additionally, the output of voltage follower U2 presents a low impedance, so the impedance into the next stage will be defined predominantly by resistor R7.

The boost term, chosen as the level of $V_{R5(t)}$ selected at the wiper of R5, is then added to the analog term FLOW_RATE_IN, which is a voltage that is a direct function of fuel flow rate. The addition is performed by operational amplifier U3, configured as an inverting amplifier, whose respective gain is set as the ratio of feedback resistor R9 to input resistor R7 for the boost term, and resistor R8 for the flow term.

The output of amplifier U3 is now a composite of both flow and boost terms, inverted in sign. This output is then input to operational amplifier U4, configured as an inverting amplifier, whose gain is set as the ratio of feedback resistor R11 to input resistor R18. The output of amplifier U4 is now corrected in sign, such that the sign of the output agrees with the original sign of FLOW_RATE_IN and the boost term provided by U2. This corrected output is labeled COMPOSITE_OUT, and represents a replacement term for the original FLOW_RATE_IN term in subsequent stages. COMPOSITE_OUT provides a time variant boost to the vapor recovery rate (increase in vapor pump RPM or vacuum) to draw in most of the vapor "puff". Expressed mathematically for this embodiment:

$$COMPOSITE_OUT(t)=$$

$$FLOW_RATE_IN+[k*(+V-V_{c1}(t))*R5/(R2+R3+R4+R5)]$$

Where k is a constant term representative of the chosen wiper position of potentiometer R5. The value of k will determine the amount of boost over the ordinary vapor flow rate and can be field-set or factory set to recover a maximum amount of the "puff" without drawing in excess air.

Lastly, when the boolean term FLOW_DETECT_IN becomes false, the output of inverter U1 drives transistor Q1 into conduction through resistor R1. With Q1 now conducting, the capacitor is discharged through the path of transistor Q1, resistor R3, and diode CR1. After a period of time determined predominantly by the value of resistor R3, the circuit will again repeat the boost term generation task when FLOW_DETECT_IN becomes true.

Figure 3:
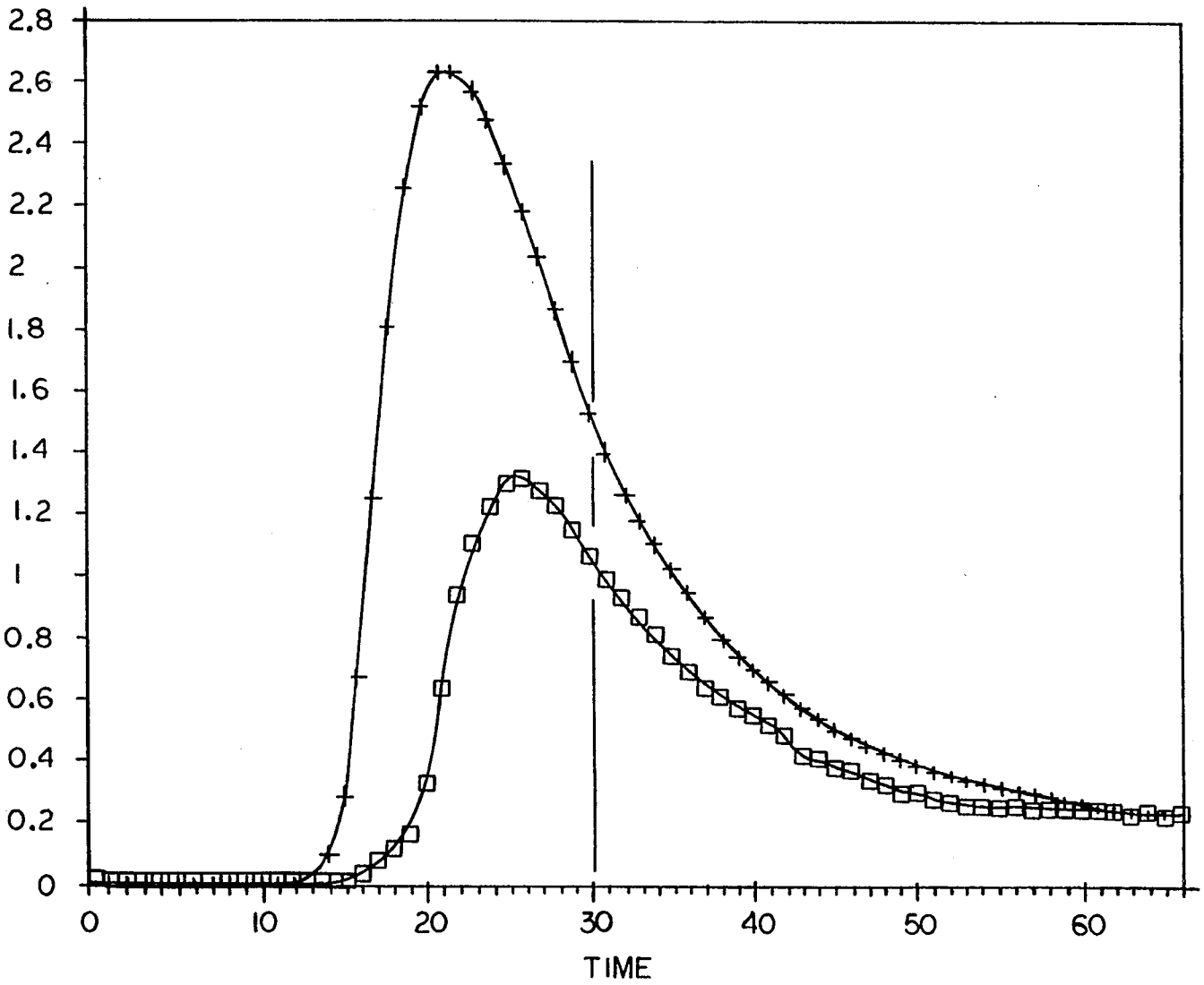
FIG. 3 is a graph of two measurements of volatile hydrocarbon vapors escaping the fill neck of a vehicle gasoline tank, comparing results obtained using the embodiment of FIG. 2 and without.

FIG. 3 depicts two measurements of volatile hydrocarbon vapors escaping the fill neck of a vehicle gasoline tank. The larger peak is the unmitigated vapor "puff" released at the onset of fueling. The smaller peak is a repeated measurement of the vapor "puff" with the circuit of FIG. 2 supplying the boost term as an additive quantity to the instantaneous flow rate.

Figure 4:
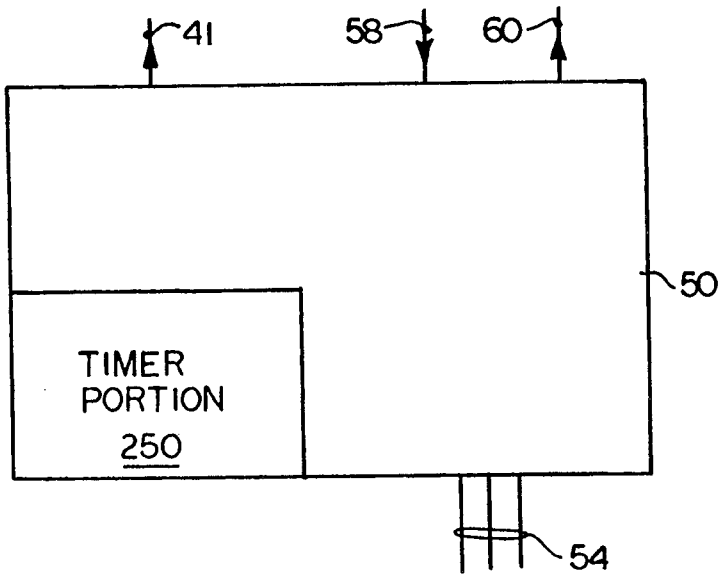
FIG. 4 is a schematic diagram of an alternate circuit for use in the fuel dispenser embodiment of FIG. 1.

FIG. 4 illustrates in block diagram form an alternate embodiment for circuitry for the controller 50 to deal with the transient "puff". In this case, a timer portion 250 of the block 50 is provided connected with the line 58 which transmits signals from the transaction computer 66. Similarly, lines 41,60 are connected to the timer as are controls for lines 54 which pass power to the motor 46.

The timer portion 250 is arrayed to have an input from the transaction computer 66 over line 58 indicating that fueling is desired to begin. When this signal is received, a signal is passed on line 41 to close the valve 42 if it is not already closed, and a signal is passed over line 54 to drive the motor 46 to start pumping vapor through the line 40, thus creating vacuum in line 40 between the valve 42 and pump 44. Also, a signal is passed to transaction computer 66 on line 60 to temporarily disable liquid pumping. Then, as the timer portion 250 expires after a delay period, signals are applied on lines 41 and 60 to open valve 42 and to permit liquid pumping. Thus, the built up vacuum in line 40 will provide a transient high suction to draw out the transient "puff," which would otherwise be released at the beginning of the liquid pumping.

Another advantage of prestarting the motor is that delays which may otherwise be inherent in the motor achieving the desired rate are not encountered.

Of course, if desired, the delay between initiation of vapor pumping and liquid pumping may be calculated otherwise, such as by sensing a desired low pressure in the line 40, or the like.

Applicants have disclosed herein two quite different ways of dealing with the transient "puff" which applicant found was released upon the initial discharge of liquid into a fuel tank. While those have been described as alternate methods, they may be used together. Those of ordinary skill in the art will readily perceive other ways of dealing with recovering the "puff," and all such methods and apparatuses are deemed to be covered by the scope of this patent.

What is claimed is:

1. An apparatus for dispensing volatile liquid fuel with recovery of fuel vapors comprising a fuel delivery system including a fuel delivery line and a pump in said line to pump fuel there-along to a nozzle, a vapor recovery subsystem including a vapor return line from said nozzle and a vapor impulsion means to induce vapor to flow through said vapor return line at an ordinary vapor flow rate through said fuel delivery line during most of a fueling operation, a vapor impulsion booster to boost the vapor flow rate above the ordinary vapor flow rage early in a fueling operation and subsequently permitting said vapor to flow at the ordinary vapor flow rate.

2. An apparatus as claimed in claim 1 wherein said vapor impulsion means is a vapor pump and said vapor impulsion booster comprises a valve in said vapor return line upstream of said vapor pump and a timer circuit operable to start said vapor pump before opening said valve and pumping with said liquid pump, whereby a reduced pressure may be drawn in said vapor return line before liquid is pumped, so that upon opening said valve, vapor flows rapidly into said vapor return line.

3. An apparatus as claimed in claim 2 wherein said vapor pump is an electrically driven pump and further comprising circuitry to operate said vapor pump at a speed to pump vapor at a rate comparable to said liquid flow rate as the ordinary vapor flow rate.

4. An apparatus as claimed in claim 1 wherein said vapor impulsion means is a vapor pump and said vapor impulsion booster comprises circuitry to operate said vapor pump at a speed to pump vapor at a rate greatly in excess of said liquid flow rate early in the fueling operation.

5. An apparatus as claimed in claim 1 wherein said vapor impulsion means is a vapor pump and said vapor impulsion booster comprises circuitry to operate said vapor pump at a speed to pump vapor at a rate greatly in excess of said liquid flow rate, the excess being characterized by a fast rise time to a maximum and a gradual decrease.

6. An apparatus as claimed in claim 5 wherein the gradual decrease is a time-decaying exponential.

7. An apparatus as claimed in claim 5 wherein the gradual decrease is time-decaying and of a wave-form selected from the group consisting of exponential, transcendental, ramp, step, pulse or a combination thereof.

8. An apparatus as claimed in claim 5 wherein the gradual increase is modulated by sensing the volume of liquid pumped.

9. An apparatus as claimed in claim 5 wherein the gradual decrease is modulated by sensing the volume of vapor recovered.

10. An apparatus as claimed in claim 1 wherein said nozzle is bootless.

11. An apparatus as claimed in claim 1 wherein the ordinary vapor flow rate is proportional to the liquid flow rate.

12. An apparatus for dispensing volatile liquid fuel with recovery of fuel vapors comprising a fuel delivery system including a fuel delivery line and a pump in said line to pump fuel there-along to a nozzle, a vapor recovery subsystem including a vapor return line from said nozzle and a vapor pump to induce vapor to flow through said vapor return line at a vapor flow rate comparable to the liquid flow rate through said fuel delivery line during most of a fueling operation, and a vapor impulsion booster circuitry to operate said vapor pump at a speed to pump vapor at a rate greatly in excess of said liquid flow rate early in a fueling operation, the excess being characterized by a fast rise time to a maximum and a gradual decrease to the rate comparable to the liquid flow rate through said fuel delivery line.

13. A method of dispensing volatile liquid fuel with recovery of fuel vapors comprising pumping fuel through a fuel delivery line at a liquid flow rate to a nozzle, returning vapors along a vapor return line from the nozzle at an ordinary vapor flow rate through the fuel delivery line during most of a fueling operation, boosting the vapor flow rate above the ordinary vapor flow rate early in a fueling operation and subsequently returning the vapors at the ordinary vapor flow rate.

14. A method as claimed in claim 13 wherein said boosting step comprises pumping the vapor along the vapor return line while a valve in the vapor return line upstream of the vapor pump is closed and subsequently opening the valve and pumping the liquid, so that a reduced pressure is drawn in the vapor return line before liquid is pumped to provide a boost to the vapor flow rate above the ordinary vapor flow rate early in the fueling operation.

15. A method as claimed in claim 14 wherein said vapor returning step comprises electrically driving a vapor pump at a speed to pump vapor at a rate comparable to the liquid flow rate as the ordinary vapor flow rate.

16. A method as claimed in claim 13 wherein said vapor returning step comprises pumping the vapor with an electrically-driven vapor pump and said boosting step comprises supplying electrical signals to the vapor pump to operate the vapor pump at a speed to pump vapor at a rate greatly in excess of the liquid flow rate early in the fueling operation.

17. A method as claimed in claim 16 wherein said vapor returning step comprises pumping the vapor with an electrically-driven vapor pump and said boosting step comprises supplying electrical signals to the vapor pump to operate the vapor pump at a speed to pump vapor at a rate greatly in excess of the liquid flow rate early in the fueling operation, the excess being characterized by a fast rise time to a maximum and a gradual decrease.

18. A method as claimed in claim 17 wherein the gradual decrease is a time-decaying exponential.

19. A method as claimed in claim 17 wherein the gradual decrease is time-decaying and of a wave-form selected from the group consisting of exponential, transcendental, ramp, step, pulse or a combination thereof.

20. A method as claimed in claim 17 wherein the gradual decrease is modulated by sensing the volume of liquid pumped.

21. A method as claimed in claim 17 wherein the gradual decrease is modulated by sensing the volume of vapor recovered.

22. A method as claimed in claim 13 wherein said fuel pumping step comprises pumping to a bootless nozzle.

23. A method of dispensing volatile liquid fuel with recovery of fuel vapors comprising pumping fuel through a fuel delivery line at a liquid flow rate to a nozzle, pumping vapor with an electrically-driven vapor pump along a vapor return line from the nozzle at a vapor flow rate comparable to the liquid flow rate through the fuel delivery line during most of a fueling operation, and supplying electrical signals to the vapor pump to operate the vapor pump at a speed to pump vapor at a rate greatly in excess of the liquid flow rate early in the fueling operation, the excess being characterized by a fast rise time to a maximum and a gradual decrease.

24. A method as claimed in claim 16 wherein said vapor returning step comprises pumping the vapor with an electrically-driven vapor pump and said boosting step comprises supplying electrical signals to the vapor pump to operate the vapor pump at a speed to pump vapor at a rate greatly in excess of the liquid flow rate early in the fueling operation, the excess being characterized by a fast rise time to a maximum.

25. An apparatus as claimed in claim 1 wherein the ordinary vapor flow rate is comparable to the liquid flow rate.

26. A method as claimed in claim 13 wherein said returning vapors step comprises returning vapors at an ordinary vapor flow rate comparable to the liquid flow rate.

* * * * *